US005868045A

United States Patent [19]

Hauk

[11] Patent Number: 5,868,045

[45] Date of Patent: Feb. 9, 1999

[54] APPARATUS FOR MAKING AND BREAKING JOINTS IN DRILL PIPE STRINGS

[75] Inventor: Thomas D. Hauk, Los Alamitos, Calif.

[73] Assignee: Hawk Industries, Inc., Long Beach, Calif.

[21] Appl. No.: 514,835

[22] Filed: Aug. 14, 1995

Related U.S. Application Data

[62] Division of Ser. No. 67,216, May 26, 1993, Pat. No. 5,386, 746.

[51] Int. Cl.[6] ..... B25B 13/50

[52] U.S. Cl. ..... 81/57.34; 81/57.16; 81/57.21

[58] Field of Search ..... 81/52, 54, 57.16, 81/57.21, 57.33, 57.34, 57.36, 105, 165, 175

[56] References Cited

U.S. PATENT DOCUMENTS 2,959,996 11/1960 Wheeler ..... 81/179
4,706,528 11/1987 Inoue ..... 81/179
5,044,232 9/1991 Schulze-Beckinghausen .... 81/57.33 X
5,060,542 10/1991 Hauk .

*Primary Examiner*—James G. Smith
*Attorney, Agent, or Firm*—Oppenheimer Wolff & Donnelly LLP

[57] ABSTRACT

Apparatus for making and breaking joints in drill pipe strings has three jaws each of which is adjustable to an infinite number of settings. The jaw-adjustment means are symmetrical about a central plane, and incorporate a spherical section. Different portions of the spherical section operate relative to closing and self-energizing of each jaw, the particular operative portion depending upon the exact set or adjusted position of the jaw. Each jaw is constructed for stable clamping of a drill type portion, with only one side of each jaw having a die element that is rotatably mounted. The jaw-adjustment mechanism effects both opening and closing of the jaw, there being no necessity to manually pull on a jaw portion at any time.

12 Claims, 4 Drawing Sheets

FIG. 3.
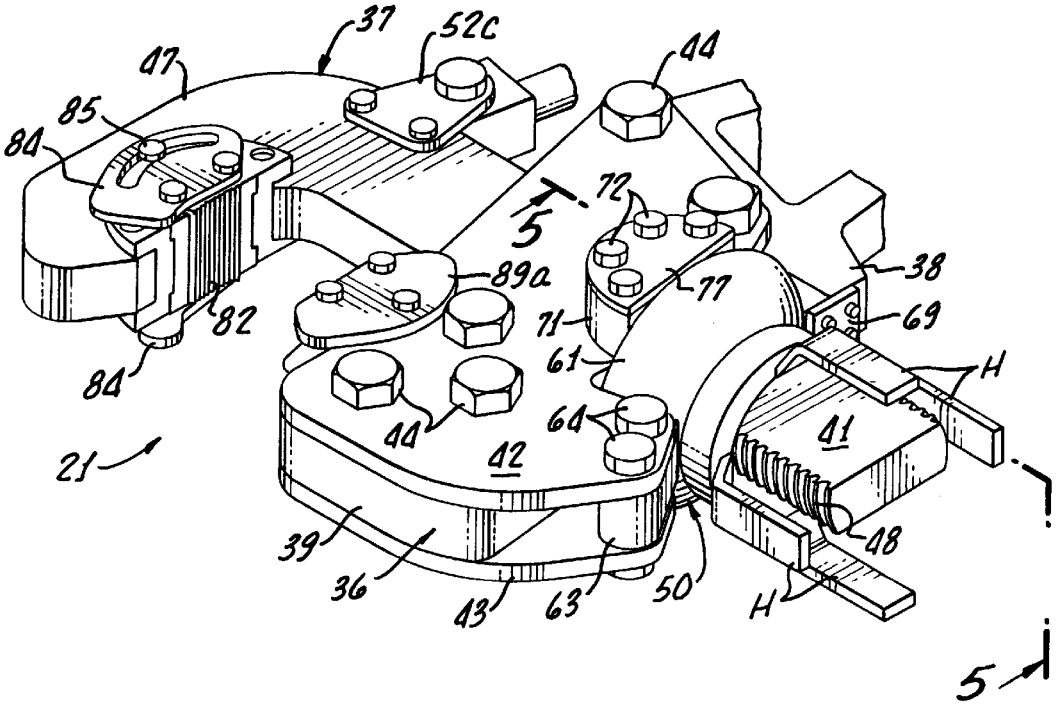
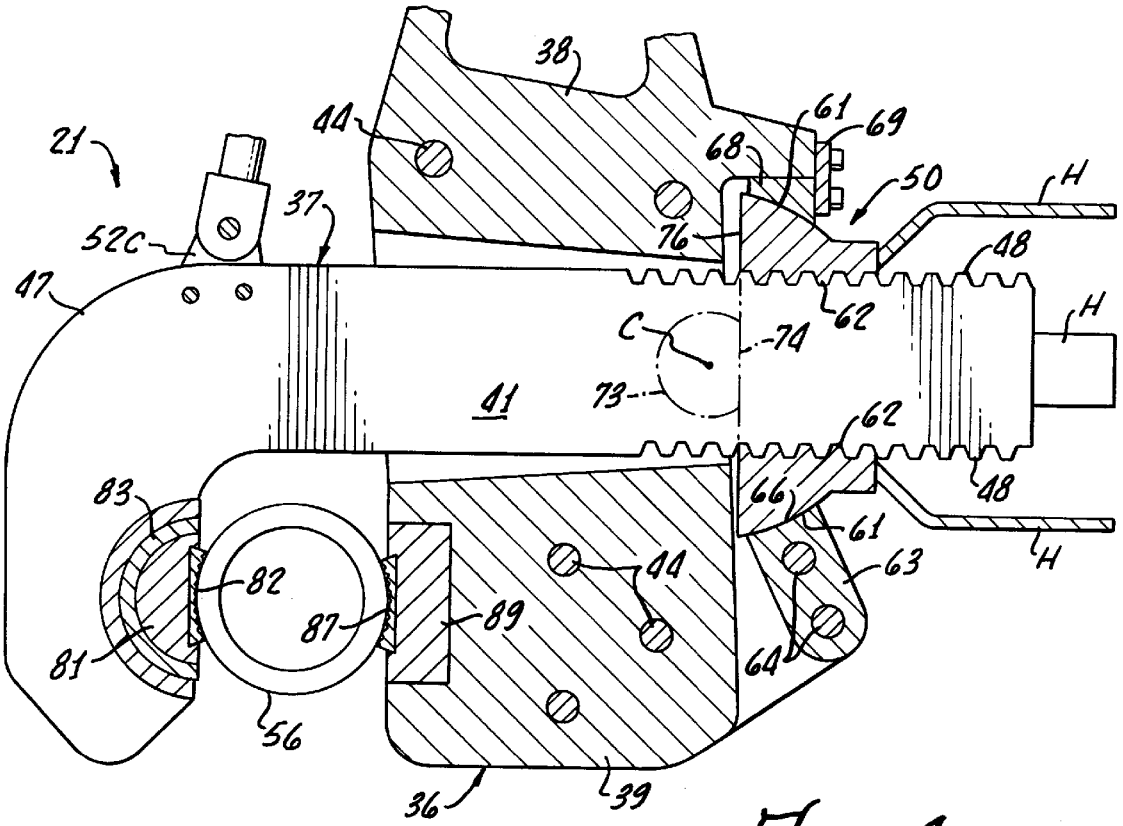
FIG. 4.

FIG. 5.
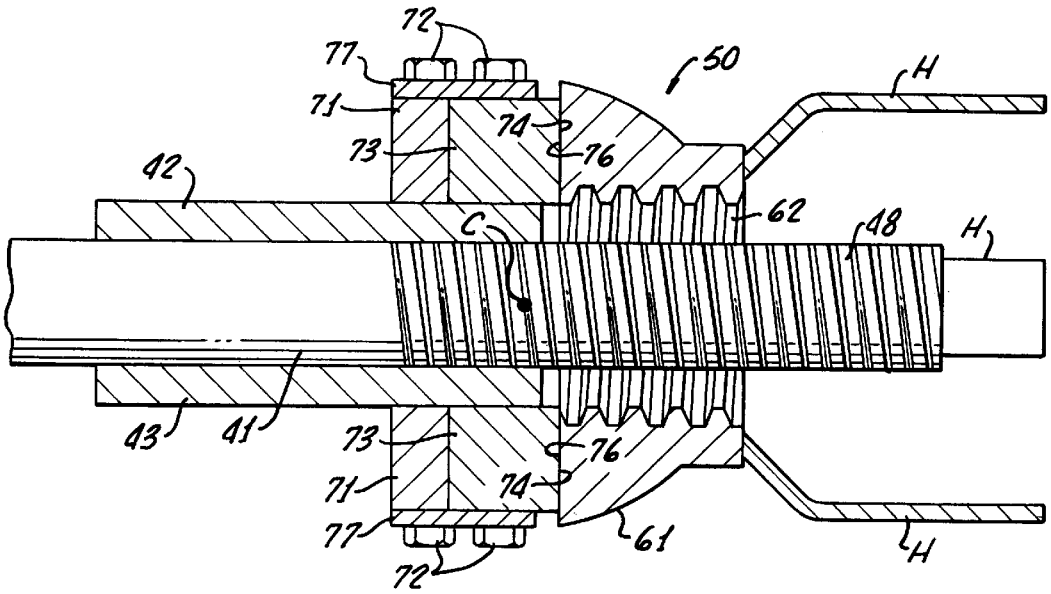
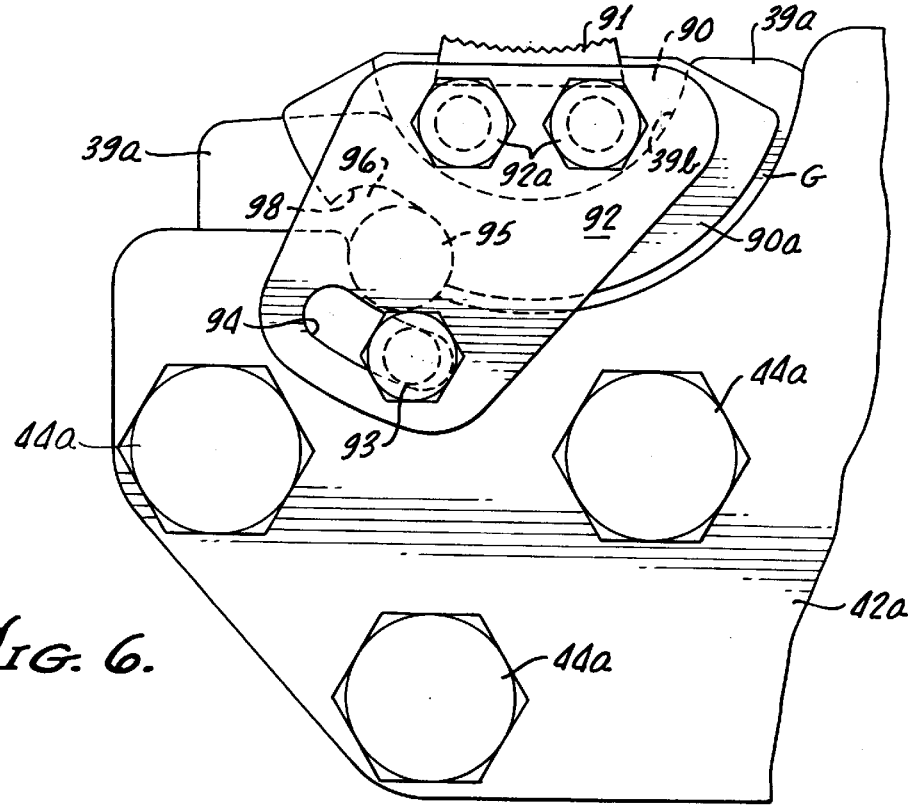
FIG. 6.

APPARATUS FOR MAKING AND BREAKING JOINTS IN DRILL PIPE STRINGS

CROSS-REFERENCE TO RELATED APPLICATIONS

This is a request for filing a divisional, under 37 C.F.R. Section 1.60, of prior application Ser. No. 08/067,216, filed May 26, 1993, now U.S. Pat. No. 5,386,746 for Apparatus for Making and Breaking Joints in Drill Pipe Strings, of Thomas D Hauk.

BACKGROUND OF THE INVENTION

In U.S. Pat. No. 5,060,542, there is described an apparatus and method for making and breaking drill pipe joints, and which is a major improvement over prior art. However, the torques generated during making and breaking of the joints are enormous. It would be highly desirable and important to achieve jaws that are more strong, more precision, more rugged, more symmetrical, more easily adjusted, more stable, etc., than are the jaws described in the cited patent.

SUMMARY OF THE INVENTION

It has now been discovered that jaws for the make-and-break apparatus can be made having the desired attributes recited in the preceding paragraph.

In accordance with one aspect of the present invention, a jaw-adjustment nut apparatus is provided that is a segment of a sphere, being adapted to rotate in either direction to any desired setting in order control the size of the gap in the associated jaw. At any one time, when part of the jaw is pivoting for initial gripping or self-energization purposes, only a portion of the sphere is operative—but the remaining portions of the sphere remain available for use during periods when other settings of the jaws have been made.

In accordance with another aspect of the invention, dies are mounted respectively in the hook end and in the head of each jaw, and only one of such dies is rotatable through a large angle about an adjacent portion of the jaw.

In accordance with another aspect of the invention, the relationships are such that the jaws may be moved in both directions in response to rotation of the nut about the spherical segment, there being no necessity to pull on any part of any jaw at any time.

BRIEF DESCRIPTION OF THE DRAWINGS

FIG. 3 is an isometric view of the jaw shown in FIG. 2;

FIG. 4 is a view, partly and horizontal section, illustrating the components of one set of jaws, the jaws being shown closed on a joint;

FIG. 5 is a vertical sectional view taken on line 5—5 of FIG. 3; and FIG. 6 is a view generally corresponding to part of the lower portion of FIG. 4 but showing a second embodiment of the tool joint-engaging die construction on the head.

DETAILED DESCRIPTION OF THE PREFERRED EMBODIMENT

Figure 1:
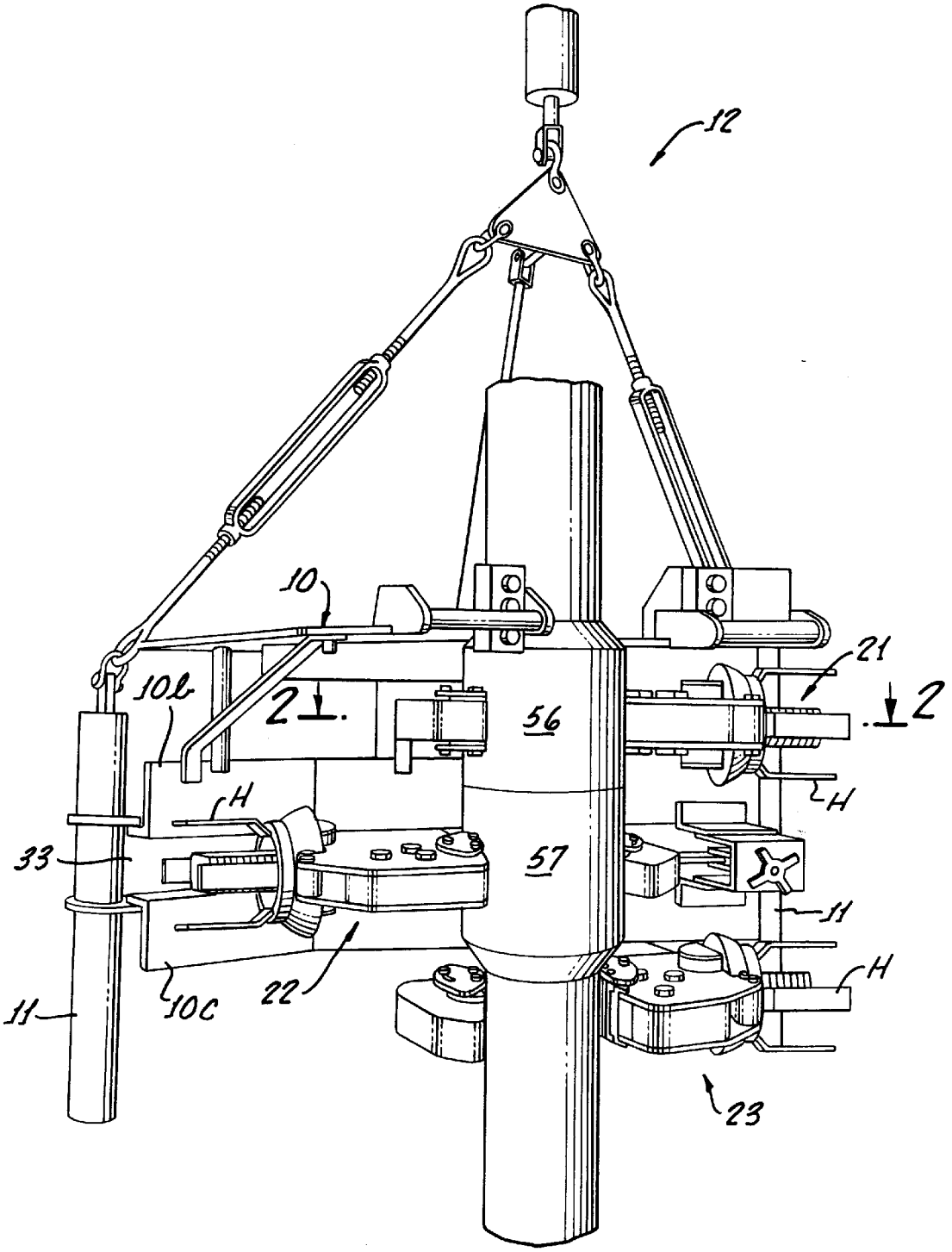
FIG. 1 is a perspective view showing the present apparatus, as mounted on a tool joint.

The above cited U.S. Pat. No. 5,060,542 is hereby incorporated by reference herein. Except as specifically stated herein, the construction of the present make-break apparatus, and the method, are substantially the same as that described in the U.S. Pat. No. 5,060,542.

Referring to the drawings, the apparatus comprises a strong welded frame 10 having legs 11 and suspended at the wellhead of an oil well by a three-element suspension means 12.

Mounted in vertically-spaced relationship on frame 10 are three sets of jaws, each in a horizontal plane. The top set of jaws is numbered 21; the middle set 22; and the bottom set 23. The top and bottom jaws 21,23 are identical to each other and are oriented identically to each other in the preferred form—the bottom set being directly below the top one.

The middle set of jaws, number 22, is reverse oriented relative to the top and bottom sets, being adapted to turn the tool joint portion in the opposite direction. The middle set of jaws is in vertical alignment with the top and bottom sets at the regions of the middle set that are adjacent the tool joint.

In the preferred embodiment, top and bottom jaws 21,23 are fixed to frame 10. Conversely, middle jaw set 22 is not fixed to the frame 10, being instead pivotally related to the frame so that the middle jaw set may pivot horizontally relative to the frame. The axis of such pivotal movement is the axis of rotation of jaws 21–23.

Figure 2:
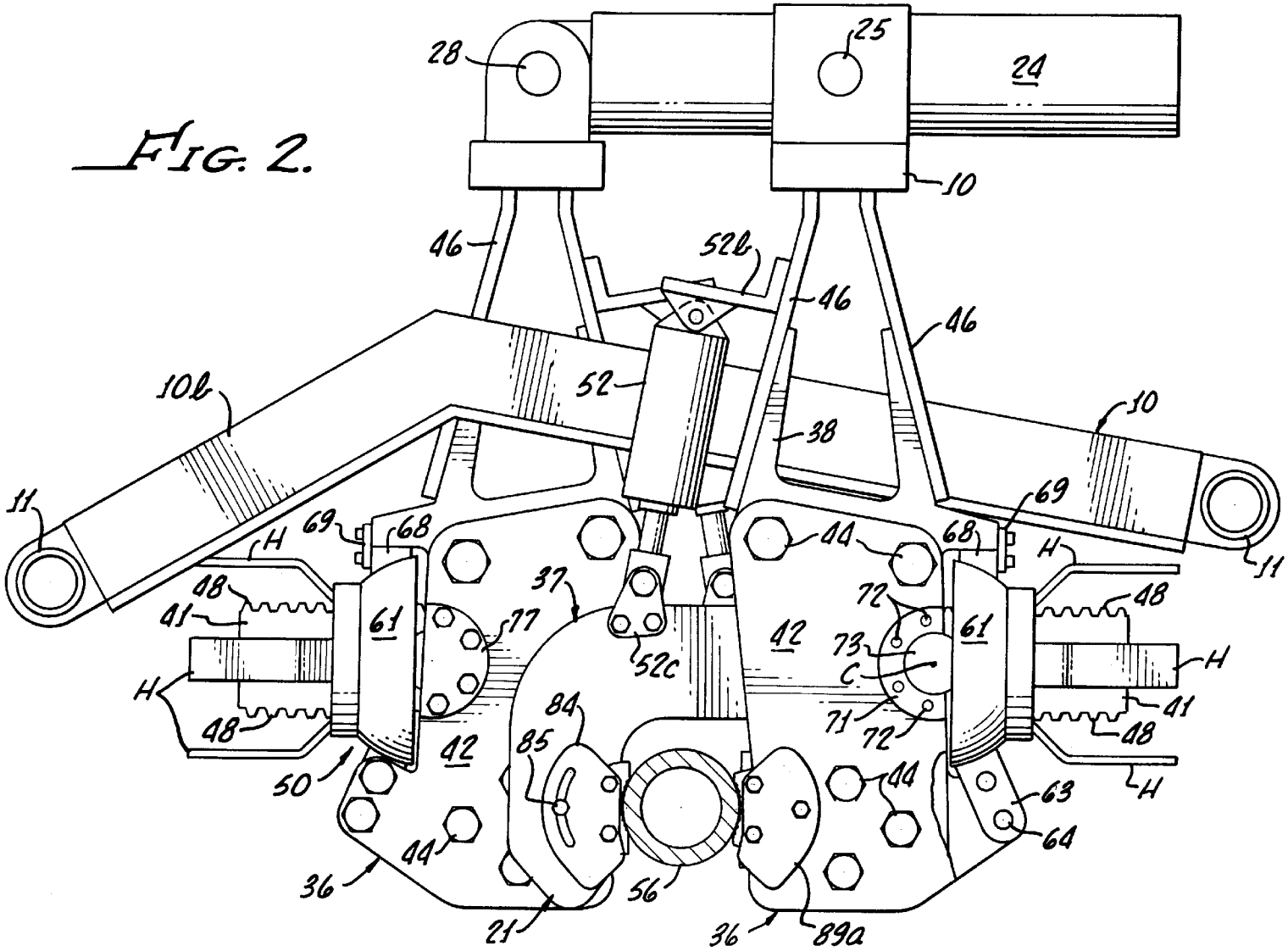
FIG. 2 shows major portions of the apparatus as viewed from above the top level of jaws, and showing the positions of parts before making of a joint.

The pivotal movement of middle jaw set 22 is effected by a torquing cylinder 24, FIG. 2. Cylinder 24 is strongly pivotally associated with frame 10 by pivot means 25 having a vertical axis.

A second strong vertical-axis pivot means 28 is connected to the middle jaw sets, this being connected to the end of the piston rod (not shown) of torquing cylinder 24. To hold the middle jaw set 22 in its horizontal plane, frame 10 includes upper and lower horizontal frame components 10*b*,10*c* which define a horizontal slot 33 as partially shown in FIG. 1. A region of middle set 22 is disposed slidably in slot 33, so that it will remain in a plane parallel to those of the top and bottom jaw sets 21,23.

In the preferred embodiment, all three jaw sets are identical to each other except that—as above indicated—the center jaw set is reversed relative to the top and bottom sets. Thus, the present description of one jaw set applies also to the other two. For convenience, the top jaw set 21 is the one described.

Top set 21 has a head 36 in which is pivotally mounted a hook 37. Head 36 is fixedly connected to the upper end of the frame. The relationships are such that after the tool joint is initially gripped by the head 36 and by hook 37, rotation of the head 36 in a clockwise direction (all rotation directions being as viewed from above) will cause additional energization (self-energization) of jaws 21 to thereby strongly and effectively grip the tool joint for torquing thereof.

Head 36 has strong thick plate elements 38 and 39 that are horizontally spaced apart so as to form an opening adapted to receive the shank 41 of hook 21 between them. Elements 38 and 39 are strongly secured to each other by top and bottom head plates 42,43 which aid in defining the opening and are held in position by bolts 44.

Element 38 of the head is strongly connected by struts 46 (FIG. 2) to the upper end of the frame.

The shank 41 of hook 37 is flat on the top and bottom sides thereof, the upper and lower surfaces of the shank lying in horizontal planes and close to head plates 42,43. The generally vertical opposite sides of shank 41, at the portion thereof remote from the hook end 47 of hook 37, are portions of the same cylinder and are strongly threaded as indicated at 48. Such cylinder has its axis at the axis of shank 41.

A large diameter, strong nut 50 is threaded onto threads 48. It has four handles H to facilitate turning in either direction. Nut 50 is associated not only with threads 48 but with other portions of a combination pivot and adjustment mechanism described in detail below. The relationships are such that rotation of nut 50 causes the jaws to open or close to the desired position relative to a particular diameter of tool joint. Furthermore, the adjustment mechanism is such that hook 37 pivots about a predetermined vertical axis relative to head 36.

Pivoting of hook 37 relative to head 36 is effected in two ways. Initially, the pivoting is effected by a bite cylinder 52, which is first operated to close the hook 37 on the tool joint so that teeth portions of dies (described below) bite initially on the tool joint. Thereafter, when the head is turned clockwise, hook 37 closes further on the tool joint to powerfully grip it.

The base end of the body of bite cylinder 52 is pivotally connected to a bracket 52*b* (FIG. 2) on a strut 46. The piston rod of cylinder 52 is pivotally connected to hook element 37 near its hook end 47, at bracket 52*c*.

The hook end 47 of hook 37 extends forwardly, away from frame 10. The gap or space between the extreme end of hook end 37 and the opposed region of head 36 is open, so that the jaw set 21 may be readily positioned around the tool joint when the entire apparatus is moved toward the tool joint prior to making or breaking thereof.

A typical tool joint is shown, having an upper component 56 threadedly connected to a lower component 57.

In operation, the upper and lower jaw sets 21,23 are alternately closed for torquing of the joint. The middle jaw set 22 is always closed for such torquing. Thus, the middle set cooperates with either the upper set or the lower set to effect torquing.

As above stated, the bottom jaw set is identical to the top one. Also as above stated, the middle jaw set 22 is identical except as indicated above and now further described.

Like upper and lower sets 21,23, the middle set 22 opens away from the frame. Two sets are simultaneously mounted on the tool joint 56,57 when the make-and-break apparatus is moved toward the joint. As above indicated, the middle set is reverse-oriented relative to the top and bottom ones. Thus, the hook end of middle jaw set 22 further energizes and rotates a tool joint component when the middle set is rotated counterclockwise (as viewed from above).

Middle jaw set is pivotally connected (as above indicated) by a pivot means 28 to the end of the piston rod of torquing cylinder 24. Stated more specifically, struts 46 associated with pivot means 28 connect to the head 36 of the middle jaws.

The Combination Pivot and Adjustment Mechanism of Each of the Jaws 21,22 and 23

Referring to FIGS. 3–5, the exterior surface of nut 50 on shank 41 of hook 37 is a surface of revolution about the axis of such nut, which axis is coincident with that of the shank 41. The exterior surface of the working portion (the left portion as viewed in FIGS. 3–5) of nut 50 is a segment 61 of a sphere, that is to say a portion of a sphere defined between parallel planes each of which is perpendicular to the common axis of nut 50 and shank 41. As shown in FIGS. 3–5, such segment of a sphere is near the right side of head 36, which right side is remote from hook end 47.

The diameter of the spherical segment 61 is relatively large, preferably much larger than the distance between the top and bottom surfaces of head 36.

The spherical segment 61 is convex and has a center located at point "C" as shown in FIG. 4. Such point "C" is located in a plane that is midway between parallel planes respectively containing the upper and lower surfaces of shank 41. To keep the center point C in such intermediate plane, and also at the longitudinal axis of shank 41, nut 50 is provided with strong interior threads 62 (FIGS. 4 and 5) that mate with the above-indicated threads 48 on the opposite edges of shank 41. Thus, at any given time, diametrically-opposite portions of threads 62 mate with threads 48 (FIG. 4).

There will next be described the bearing and retainer means associated with nut 50. A strong bearing block 63 is sandwiched between head plates 42,43 as shown in FIGS. 3 and 4, being held very strongly in position by bolts 64. The inner surface 66 of bearing block 63 is spherical (and concave), and is substantially coincident with a portion of the spherical segment 61 when the apparatus is in the assembled condition shown in the drawings.

A second bearing (or retainer) block, numbered 68 in FIGS. 2 and 4, need not be nearly so strong; it is secured by a plate 69 and suitable screws to the plate element 38. Second block 68 has a concave surface that extends surface 61 when the parts are assembled as illustrated. Such concave surface could be spherical but need not be. It is preferably loosely engaged with the sphere 61, and operates as a retainer.

Thus, bearing blocks 63 and 68 and their spherical surface form bearing and retainer means for nut 50, at spherical segment 61. This permits the nut 50 to rotate in two ways, namely about the longitudinal axis of shank 41, and about a vertical axis that is perpendicular to the upper and lower surfaces of shank 41 and that passes through center C. The bearing block 63 and associated bolts are strong because large forces are created between surfaces 61,66 during operation of the apparatus to rotate a section of a drill pipe joint.

Four of the above-indicated handles H are welded to nut 50 in equally spaced relationship about the axis thereof, to permit manual rotation of the nut 50 on shank 41 in either direction, depending upon whether the shank 41 and the entire hook 37 are to be adjusted to the right or to the left as viewed in FIGS. 3 and 4.

It is to be understood that center C is not fixed in position relatively to the shank 41. It is, instead, fixed in position relative to spherical segment 61 which in turn is fixed in position by the bearing blocks 63 and 68 as well as by bearing means described in the following paragraph.

Thrust bearing means, which are also part of the retainer and positioning means for nut 50, are provided on head 36, and comprise bearing surfaces that—regardless of the pivoted position of hook 37 relative to head 36—lie in one of the planes (namely the left planes in FIGS. 3 and 4) defining the spherical segment 61. These are best shown in FIGS. 2, 3 and 5, it being understood that a bearing cover (upper plate) is not shown at the right side of FIG. 2 though it is shown at the left side thereof. The thrust bearing means are on the upper and lower sides of head 36, and are mirror images of each other relative to a horizontal plane containing the longitudinal axis of shank 41.

An arcuate element 71, extending for somewhat more than 180°, is mounted by bolts 72 on a plate 42 or 43. The vertical axis of each arcuate element 72 extends through center C and is perpendicular to the upper and lower surfaces of shank 41. A rotatable bearing 73 is mounted rotatably in each arcuate element 71, such bearing being cylindrical and having a diameter only slightly smaller than the diameter of the inner surface of arcuate element 71.

One side of the rotatable bearing 73 is cut off at a plane that is parallel to the axis of bearing 73 (this being also the axis of arcuate element 71). There is thus formed a bearing surface 74 (FIG. 5) in such plane, which bearing surface is somewhat further from the hook end 47 of hook 37 than are the end edges of arcuate element 71. Thus, the bearing surface may remain in sliding contact with nut 50 even though hook 37 pivots somewhat relative to head 36. The face of nut 50 closest to the hook end 47 of hook element 37 is radial (lying in the above-indicated one plane) and is numbered 76, being in sliding contact with each bearing surface 74 (it being emphasized that there are upper and lower mirror-image bearing assemblies each having a surface 74).

Face 76 is located sufficiently far (FIG. 4) from head 36 to permit pivotal movement of the hook 37 in a horizontal plane through a sufficient angle to open and close the jaws and to permit the jaws to energize. The head opening defined between plates 38,39,42 and 43 is also sufficiently large to permit such pivotal movement.

The bolts 72 extend in each instance through a horizontal cover plate 77, which retains bearing 73 in position but does not interfere with rotation of bearing 73 about the vertical axis through center C.

Operation of the Apparatus as Thus-far Described

Let it be assumed that the various cylinders are not pressurized, and that it is desired to change the size of the opening (gap) in each jaw set so that the make-break tool may operate on a different predetermined diameter of tool joint 56,57 in the drill pipe string such as is shown in FIG. 1.

It is then merely necessary to employ handles H in such manner as to spin the three nuts 50 of the three jaw sets 21,22 and 23 to previously determined settings. (In some cases, only two jaws sets are adjusted at a time.) It is to be understood that a scale (or gauge) (not shown) is provided on the shank 41 of each jaw, and these scales have previously-determined markings which when registered with the face of each nut 50 remote from face 76 will indicate to the user that the hook 37 is adjusted to the correct position for a particular diameter of joint.

Because each nut 50 is trapped rotatably between bearings 73,63 and 68, rotation of each nut 50 in either direction will operate through the threads 48,62 to achieve precise movement of shank 41 in either direction to the desired setting. Whether the shank moves to the right or left in FIGS. 3 and 4, for example, makes no difference because either direction of movement is as easily accomplished.

The set-up for the different diameter of tool joint also involves setting (adjusting) stop elements such as are described in the cited U.S. Pat. No. 5,060,542—thereby determining the positions of stop ends 91 shown in FIG. 3 of said patent. These ends are adapted to engage the tool joint in order to achieve correct positioning of the present make-break tool relative to the particular diameter of tool joint.

After the tool is positioned with two of the three jaw openings receiving the tool joint, the appropriate ones of the bite cylinders 52 (FIG. 2) are pressurized so as to move their associated hooks 37 forwardly into clamping relationship with the tool joint. Then, to make or break a joint, torquing cylinder 24 (FIG. 2) is pressurized so as to extend the piston rod (shown in the cited patent) therefrom and thus widely separate the second pivot means 28 (FIG. 2) from cylinder 24. This does two things; it tightens (energizes) each set of jaws so as to increase greatly the gripping force on the associated tool joint section, and it rotates the appropriate tool joint section in the desired direction to make or break the joint. Whether the joint is made or broken depends on which of jaw sets 21,23 is in use (in FIG. 1 the top jaw set is in use and the bottom one is not).

When each set of jaws because thus energized, and when each bite cylinder 52 is operated, each hook 37 pivots about the vertical axis through point C indicated in FIG. 4. Such axis is the center of each bearing 73 and such point C is the center of spherical segment 61.

It is emphasized that when hook 37 rotates in a horizontal plane relative to its associated head 36, only two small portions of spherical segment 61 are utilized. These two portions are those engaged by the spherical faces of bearings 63,68. These small portions lie in the same plane as that of hook 37. On the other hand, during adjustment of the size of the jaw opening in either direction, prior to use of the apparatus to actually make or break a joint, the handles H are rotated so that annular portions of the spherical segment 61 are utilized about (typically) the full circumference of nut 50.

There has thus been described a jaw hook pivoting and jaw hook adjusting mechanism that operates with great precision and great strength. The bearing loads between surfaces 74 and 76, and surfaces 61 and 66, are extremely high during the period when a tool joint is actually being made or broken. The symmetrical nature of the parts, and the size and strength of the elements, result in extremely strong and rugged constructions such as are needed for oil field use.

After the joint has been made or broken, the bite cylinders 52 are operated to retract the hooks 37 away from the drill pipe string, following which the drill pipe string is moved axially to such position that the next joint may be made or broken as desired.

Description of the Apparatus for Biting, With Precision and Stability, on the Tool Joint Especially because of the high forces involved, the above-specified precision relative to the axis of each hook 37, the setting of each hook 37, etc., are of great importance. It has further been discovered that by providing certain rotatable and nonrotatable, or small-angle rotatable, die constructions at the opposed faces of the hook end and the head, the strength and stability of the gripping action are much enhanced.

Referring to FIGS. 2–4, this is the first embodiment of die construction.

On the hook end 47 of hook 37, there is a rotatable die segment 81 (FIG. 4) which carries a replaceable, toothed, concave die 82 and which rotates in a bearing 83 in the hook end. End plates 84 are mounted, by screws, on the ends of the die segment 81. There is cooperation between a pin 85 on the hook end, and long arcuate slots in end plates 84, to permit the die segment 81 and thus die 82 to rotate through a large angle about a vertical axis.

Accordingly, and since the described elements 81,82 and 84 rotate relatively freely about the indicated vertical axis, die 82 will self-pivot to a desired angle at which substantial numbers of the vertical die teeth thereof engage the outer side of tool joint section 56 (FIG. 4). For a further description of the die and associated die segment used relative to the hook end of the jaw, reference is made to FIG. 7 of the cited U.S. Pat. No. 5,060,452 (the end plates in such FIG. 7 are larger than those shown herein).

It has now been discovered that, in the present apparatus, the amount of movement of the die on the head 36 should be limited and not free and through a wide angle as is the case relative to the die associated with the hook end 47. In the embodiment of FIG. 4 (and of the other drawings except FIG. 6), the die on head 36 is fixed and does not rotate at all relative to the head. As shown at the center region of the lower portion of FIG. 4, the illustrated die 87 is mounted in a fixed rectangular block 89 which is nonrotatably mounted in a complementary rectangular recess in plate element 39 of head 36. The die 87 is diametrically opposite die 82 when the tool joint section 56 is centered as shown in FIG. 4. Top and bottom plates 89*a*, and suitable screws, hold elements 87,89 in position.

With the die combination of FIG. 4, there is more stability—than with the die combination described in the cited patent—due to the fact that die 87 does not rotate relative to head 36. It follows that when hook 37 is pivoted counterclockwise (as viewed from above) from the position of FIG. 4, there will be less tendency for the die 87 to shift relative to pipe joint section 56. One result is that the angle through which the pipe joint section is rotated in response to full lengthening of torquing cylinder 24 (FIG. 2) is maximized.

In order to achieve substantially all of the benefits of the embodiment of FIG. 4 but still facilitate precision mounting of the jaws on joint section 56, and also to better spread the load over different teeth of die 87, another embodiment is provided as shown in FIG. 6.

Embodiment of FIG. 6

The embodiment of FIG. 6 is in all respects identical to the embodiment described in all preceding portions of the present application, with the sole exception that the die assembly associated with the head 36 of each jaw set is that of FIG. 6 instead of that of FIG. 4.

In FIG. 6, the die assembly on head 36 is a rotatable die segment 90 that rotates about a vertical axis, as in the case of die segment 81. Segment 90 rotates in a cylindrical recess or bearing portion 39*b* of plate 39*a*. Such die segment 90 carries a die 91. Furthermore, there are top and bottom plates 92 that are secured by screws 92*a* to die segment 90 as in the case of plates 84 associated with the hook end. Screws 92*a* cooperate with associated arcuate slots 94 and with pin 93 to hold the die segments in the proper positions during periods when the joints are not being made or broken.

Plates 92 are small because the die segment 90 and die 91 pivot only through a small angle about the vertical pivot axis. A typical small angle of pivoting is 5°, being vastly less (a small fraction) than the angle through which die segment 81 associated with hook end 47 may pivot.

In the present embodiment, pivoting of the die segment on the head is stopped by brute force—by strong stop means. In the previous embodiment of hook-end die means, and in all die means of the cited patent, pivoting of the die cease by friction and not by action of stop means.

There are wide, thick top and bottom arcuate flanges 90*a* that seat above and below plate 39*a*. These flanges are in recesses in top plate 42*a* and in the unshown bottom plate, there being radial gaps G between these elements radially-outwardly of the flanges 90*a*.

The slots 94 and associated pins 93 do not at all control the angle through which die segment 90 pivots during mounting on the joint section or during actual torquing. Slots 94 are so long that their ends never contact pin 93. The pivot angle is controlled, instead, by a very strong large-diameter pin 95 that is anchored in a hole in plate element 39*a* of head 36. This large pin 95 extends upwardly and downwardly, above and below plate 39*a*, into anchoring grooves in plate 42*a* and in the unshown bottom plate. It also extends, above and below plate 39*a*, into top and bottom short recesses (half-slots) 96 in the top and bottom flanges 90*a* of die segment 90.

In the operation of the embodiment of FIG. 6, the large pin 95, after the jaws are mounted on a tool joint section, is typically spaced away from the end wall 98 of each short recess 96 prior to the time that actual torquing commences. (Stated otherwise, the end wall 98 is spaced from pin 95.) However, a certain amount of pivotal movement of the die segment 90 and die 91 has been permitted, to permit the die 91 to adjust or center itself relative to the tool joint surface (circle) so that a relatively large number of die teeth are engaged and the load is spread, more tangency being achieved. Thus, when torquing commences, the pin 95 is (as above stated) often spaced away from end wall 98 and typically not engaged therewith. The locations of recesses or slots 96 are such that the die segments center, that is to say become tangent, before walls 98 are engaged.

Upon commencement of torquing, that is to say extension of the main cylinder 24 as described above and in the cited patent, the direction of rotation is such that the large pin 95 tends to move toward end wall 98. Thus, the maximum amount that die segment 90 and die 91 may shift relative to pin 95 is (typically) 5°. After the (maximum) about 5° movement, pin 95 engages end wall 98 and the two move together. The die segment 90 no longer can rotate relative to the head plate 39*a*. There is thus brute-force stopping of rotation of the pin 95 by the wall 98 or (stated otherwise) of wall 98 by the pin 95.

Accordingly, with the construction of FIG. 6, the die 91 can adjust itself and spread the load between teeth, but there is not so much adjustment as to create any substantial tendency to generate instabilities or to permit large lost motion during actual torquing.

The foregoing detailed description is to be clearly understood as given by way of illustration and example only, the spirit and scope of this invention being limited solely by the appended claims.

What is claimed is:

1. A power jaw apparatus for applying high torques to sections of threadedly connected pipe, which comprises:

(a) at least one set of jaws adapted to apply torque in only a single direction to a section of threaded pipe, said jaw set having a head element through which is provided an opening, said jaw set also having a hook element, said hook element having a shank extending through said opening in said head element, said hook element also having a hook end connected to said shank on one side of said head element, said hook end and said head element defining between them a gap adapted to receive a pipe section, said hook end and said head element being adapted to grip a pipe section when it is in said gap, (b) adjustable means to pivotally associate said hook element with said head element for pivotal movement of said hook element relative to said head element about a predetermined axis, said adjustable means also effecting movement of said shank in at least one direction through said opening to thereby increase or decrease the size of said gap whereby to adapt the power jaw apparatus for torquing of different diameters of pipe sections, and (c) an elongate power cylinder to exert a large force on said head to thereby rotate said head about a pipe section that is gripped in said gap for high-torque torquing of said pipe section about the axis of said pipe section, characterized in that first toothed die means are provided on said hook end and second toothed die means are provided on said head, and in that (said first toothed die means) is mounted for rotation relative to said hook end through a relatively large angle, and (said second toothed die means) is mounted for rotation relative to said head about an angle which is small relative to said relatively large angle.

2. The invention as claimed in claim 1, in which means are provided to mount said second die means rotatably relative to said head but only for rotation through a small angle that is a small fraction of the angle through which said first die means may rotate relative to said hook end.

3. The invention as claimed in claim 1, in which said first and second die means are somewhat concave, the direction of concavity being such that said die means somewhat fit around the pipe section that is gripped in said gap.

4. The invention as claimed in claim 1, in which a bite cylinder is connected between said head element and said hook element of said jaw set, to effect closing of said jaw set prior to operation of said elongate power cylinder to exert a large force on said head.

5. The invention as claimed in claim 1, in which said jaw set is any of three jaw sets in an apparatus for making and breaking threaded joints between pipe sections, said three jaw sets being first, second and third power jaw sets each adapted to strongly torque a pipe section in only a single direction, and in which means are provided to interconnect said first, second and third jaw sets with each other, said interconnection means and said jaw sets being so oriented that: (1) two of said jaw sets can apply strong torque to a threaded joint between a pair of threadedly-connected pipes sections, in a direction to make said joint, (2) two of said jaw sets can apply strong torque to said joint in a direction to break said joint, and (3) said second-mentioned two jaw sets includes the one of said jaw sets that was not included in said first-mentioned two jaw sets.

6. A power jaw apparatus for applying high torques to sections of threadedly connected pipe, which comprises:

(a) at least one set of jaws adapted to apply torque in only a single direction to a section of threaded pipe, said jaw set having a head element through which is provided an opening, said jaw set also having a hook element, said hook element having a shank extending through said opening in said head element, said hook element also having a hook end connected to said shank on one side of said head element, said hook end and said head element defining between them a gap adapted to receive a pipe section, said hook end and said head element being adapted to grip a pipe section when it is in said gap, (b) adjustable means to pivotally associate said hook element with said head element for pivotal movement of said hook element relative to said head element about a predetermined axis, said adjustable means also effecting movement of said shank in at least one direction through said opening to thereby increase or decrease the size of said gap whereby to adapt the power jaw apparatus for torquing of different diameters of pipe sections, and (c) an elongate power cylinder to exert a large force on said head to thereby rotate said head about a pipe section that is gripped in said gap for high-torque torquing of said pipe section about the axis of said pipe section, characterized in that first toothed die means are provided on said hook end and second toothed die means are provided on said head, and in that (said first toothed die means) is mounted for rotation relative to said hook end through a relatively large angle, (and said second toothed die means) is mounted in fixed relationship on said head.

7. The invention as claimed in claim 6, in which said first and second die means are somewhat concave, the direction of concavity being such that said die means somewhat fit around the pipe section that is gripped in said gap.

8. The invention as claimed in claim 6, in which a bite cylinder is connected between said head element and said hook element of said jaw set, to effect closing of said jaw set prior to operation of said elongate power cylinder to exert a large force on said head.

9. The invention as claimed in claim 6, in which said jaw set is any of three jaw sets in an apparatus for making and breaking threaded joints between pipe sections, said three jaw sets being first, second and third power jaw sets each adapted to strongly torque a pipe section in only a single direction, and in which means are provided to interconnect said first, second and third jaw sets with each other, said interconnection means and said jaw sets being so oriented that: (1) two of said jaw sets can apply strong torque to a threaded joint between a pair of threadedly-connected pipes sections, in a direction to make said joint, (2) two of said jaw sets can apply strong torque to said joint in a direction to break said joint, and (3) said second-mentioned two jaw sets includes the one of said jaw sets that was not included in said first-mentioned two jaw sets.

10. A power jaw apparatus for applying high torques to sections of threadedly connected pipe, which comprises:

(a) at least one set of jaws adapted to apply torque in only a single direction to a section of threaded pipe, said jaw set having a head element through which is provided an opening, said jaw set also having a hook element, said hook element having a shank extending through said opening in said head element, said hook element also having a hook end connected to said shank on one side of said head element, said hook end and said head element defining between them a gap adapted to receive a pipe section, said hook end and said head element being adapted to grip a pipe section when it is in said gap.

(b) adjustable means to pivotally associate said hook element with said head element for pivotal movement of said hook element relative to said head element about a predetermined axis, said adjustable means also effecting movement of said shank in at least one direction through said opening to thereby increase or decrease the size of said gap whereby to adapt the power jaw apparatus for torquing of different diameters of pipe sections, and (c) an elongate power cylinder to exert a large force on said head to thereby rotate said head about a pipe section that is gripped in said gap for high-torque torquing of said pipe section about the axis of said pipe section, characterized in that first toothed die means are provided on said hook end and second toothed die means are provided on said head, and in that (said first toothed die means) is mounted for rotation relative to said hook end and (said second toothed die means) is mounted for rotation relative to said head about an angle of only about five degrees.

11. The invention as claimed in claim 10, in which a bite cylinder is connected between said head element and said hook element of said jaw set, to effect closing of said jaw set prior to operation of said elongate power cylinder to exert a large force on said head.

12. The invention as claimed in claim 10, in which said jaw set is any of three jaw sets in an apparatus for making and breaking threaded joints between pipe sections, said three jaw sets being first, second and third power jaw sets each adapted to strongly torque a pipe section in only a single direction, and in which means are provided to interconnect said first, second and third jaw sets with each other, said interconnection means and said jaw sets being so oriented that: (1) two of said jaw sets can apply strong torque to a threaded joint between a pair of threadedly-connected pipes sections, in a direction to make said joint, (2) two of said jaw sets can apply strong torque to said joint in a direction to break said joint, and (3) said second-mentioned two jaw sets includes the one of said jaw sets that was not included in said first-mentioned two jaw sets.

* * * * *

UNITED STATES PATENT AND TRADEMARK OFFICE

CERTIFICATE OF CORRECTION

PATENT NO. : 5,868,045
DATED : February 9, 1999
INVENTOR(S) : Thomas D. Hauk

It is certified that error appears in the above-identified patent and that said Letters Patent is hereby corrected as shown below:

Title page,
Insert Item:
-- [*] Notice: The term of this patent is extended under 35 U.S.C. 154(b) by 789 days. --

Signed and Sealed this

Twenty-second Day of February, 2005

JON W. DUDAS
*Director of the United States Patent and Trademark Office*